US009805683B2

(12) United States Patent
Yao et al.

(10) Patent No.: US 9,805,683 B2
(45) Date of Patent: Oct. 31, 2017

(54) GATE DRIVER ON ARRAY CIRCUIT FOR DIFFERENT RESOLUTIONS, DRIVING METHOD THEREOF, AND DISPLAY DEVICE INCLUDING THE SAME

(71) Applicant: BOE TECHNOLOGY GROUP CO., LTD., Beijing (CN)

(72) Inventors: Xing Yao, Beijing (CN); Seungwoo Han, Beijing (CN); Yuanbo Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 59 days.

(21) Appl. No.: 14/906,475

(22) PCT Filed: Aug. 18, 2015

(86) PCT No.: PCT/CN2015/087338
§ 371 (c)(1),
(2) Date: Jan. 20, 2016

(87) PCT Pub. No.: WO2016/138745
PCT Pub. Date: Sep. 9, 2016

(65) Prior Publication Data

US 2016/0379585 A1 Dec. 29, 2016

(30) Foreign Application Priority Data

Mar. 2, 2015 (CN) ..... 2015 1 0093150

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 3/3696* (2013.01);
(Continued)

(58) Field of Classification Search
None
See application file for complete search history.

(56) References Cited

U.S. PATENT DOCUMENTS

2008/0012842 A1* 1/2008 Mori ..... G09G 3/3677 345/206
2011/0248966 A1 10/2011 Ahn et al.

FOREIGN PATENT DOCUMENTS

CN 1790139 A 6/2006
CN 101995689 A 3/2011
(Continued)

OTHER PUBLICATIONS

International Search Report dated Nov. 13, 2015 issued in corresponding International Application No. PCT/CN2015/087338 along with an English translation of the Written Opinion of the International Searching Authority.

*Primary Examiner* — Amr Awad
*Assistant Examiner* — Donna Lui
(74) *Attorney, Agent, or Firm* — Nath, Goldberg & Meyer; Joshua B. Goldberg

(57) ABSTRACT

The present invention discloses a Gate-driver-On-Array (GOA) circuit and the driving method thereof and a display device. The GOA circuit comprises a driving module, a low-resolution module and at least two high-resolution modules, the driving module being connected with the low-resolution module and the at least two high-resolution modules respectively; wherein, the driving module is used to output control signal to the low-resolution module and the high-resolution modules; the low-resolution module is used to output a low-resolution signal to at least two rows of pixels under the control of the control signal during low-resolution display; and each high-resolution module is used to output a high-resolution signal to corresponding one row of pixels under the control of the control signal during
(Continued)

high-resolution display. The GOA circuit of the present invention may be used to drive multiple rows of pixels and implement the switching between low resolution display and high resolution display.

15 Claims, 3 Drawing Sheets

(52) U.S. Cl.
CPC ..... *G09G 2300/0809* (2013.01); *G09G 2310/0267* (2013.01); *G09G 2310/0286* (2013.01); *G09G 2330/021* (2013.01)

(56) References Cited

FOREIGN PATENT DOCUMENTS

| | | | |
|---|---|---|---|
| CN | 104090436 | A | 10/2014 |
| CN | 104599627 | A | 5/2015 |

* cited by examiner

GATE DRIVER ON ARRAY CIRCUIT FOR DIFFERENT RESOLUTIONS, DRIVING METHOD THEREOF, AND DISPLAY DEVICE INCLUDING THE SAME

CROSS-REFERENCES TO RELATED APPLICATIONS

This is a National Phase Application filed under 35 U.S.C. 371 as a national stage of PCT/CN2015/087338, filed Aug. 18, 2015, an application claiming the benefit from the Chinese patent Application No.201510093150.6, filed Mar. 2, 2015, the content of which is hereby incorporated by reference in its entirety.

FIELD OF THE INVENTION

The present invention relates to the technical field of display, and particularly relates to a Gate driver On Array circuit, a driving method thereof and a display device including the same.

BACKGROUND OF THE INVENTION

Gate driver On Array (referred to as GOA) technology is a process technology of fabricating Gate driver ICs directly on an array substrate. Compared with conventional process technologies of fixing integrated circuits (ICs) onto a Chip On FPC (referred to as COF) and fixing ICs onto a Chip On Glass (referred to as COG), the GOA technology not only simplifies the fabrication procedures and reduces the process cost of the products, but also improves the integration of a thin film transistor liquid crystal display (i.e., TFT-LCD) panel. Due to these advantages, the GOA technology is easily applied in display devices.

In a conventional display device, one GOA circuit can only drive one row of pixels and only corresponds to one resolution. However, with the improvement of the screen resolution of display device, if such conventional GOA circuit continues to be used, the number of required GOA circuits is large, and the screen resolution cannot be changed once it is determined.

Therefore, following technical problems occur if the conventional GOA circuit is used in an existing display device:

1) one GOA circuit can only drive one row of pixels, which causes a large number of GOA circuits in the display device;

2) the GOA circuit can display the contents with only one resolution and not be able to implement switching between low resolution display and high resolution display, such that the resolution of an array substrate may not be configured flexibly, and the power consumption of the display device during display is increased, which causes a waste of energy.

SUMMARY OF THE INVENTION

In order to resolve the above technical problems existing in the prior art, the present invention provides a GOA circuit, a driving method thereof and a display device including the same, which can reduce the number of GOA circuits in the display device, lower the power consumption, and save energy.

To achieve the above object, the present invention provides a GOA circuit which comprises a driving module, a low-resolution module and at least two high-resolution modules, the driving module being connected with the low-resolution module and the at least two high-resolution modules, respectively; wherein, the driving module is used to output a control signal to the low-resolution module and each of the high-resolution modules;

the low-resolution module is used to output a low-resolution signal to at least two rows of pixels under the control of the control signal during low-resolution display; and each of the at least two high-resolution modules is used to output a high-resolution signal to corresponding one row of pixels under the control of the control signal during high-resolution display.

Optionally, the low-resolution module includes a low-resolution signal generation unit and a low-resolution signal output unit; wherein, the low-resolution signal generation unit is used to generate the low-resolution signal according to a first clock signal under the control of the control signal; and the low-resolution signal output unit is used to output the low-resolution signal to the at least two rows of pixels.

Optionally, the low-resolution signal generation unit includes a fifth switching transistor, a first capacitor and a sixth switching transistor;

a control terminal of the fifth switching transistor is connected to a first end of the first capacitor and the driving module, respectively, a first terminal of the fifth switching transistor is connected to a first clock signal generation unit, and a second terminal of the fifth switching transistor is connected to a second end of the first capacitor, a first terminal of the sixth switching transistor and the low-resolution signal output unit, respectively; and a control terminal of the sixth switching transistor is connected to the driving module, and a second terminal of the sixth switching transistor is connected to a third power supply.

Optionally, the low-resolution signal output unit is used to output the low-resolution signal to two rows of pixels, and the low-resolution signal output unit includes a seventh switching transistor and an eighth switching transistor;

a control terminal of the seventh switching transistor is connected to a fifth power supply, a first terminal of the seventh switching transistor is connected to a first terminal of the eighth switching transistor and the low-resolution signal generation unit, respectively, and a second terminal of the seventh switching transistor is connected to the first row of pixels; and a control terminal of the eighth switching transistor is connected to the fifth power supply, and a second terminal of the eighth switching transistor is connected to the second row of pixels.

Optionally, the low-resolution signal output unit further includes a ninth switching transistor and a tenth switching transistor;

a control terminal of the ninth switching transistor is connected to the fifth power supply, a first terminal of the ninth switching transistor is connected to the low-resolution signal generation unit, and a second terminal of the ninth switching transistor is connected to a first terminal of the tenth switching transistor, the first terminal of the seventh switching transistor and the first terminal of the eighth switching transistor, respectively; and a control terminal of the tenth switching transistor is connected to a sixth power supply, and a second terminal of the tenth switching transistor is connected to the third power supply.

Optionally, each of the at least two high-resolution modules includes a high-resolution signal generation unit and a high-resolution signal generation unit; wherein, the high-resolution signal generation unit is used to generate the high-resolution signal according to a clock signal that is different from the first clock signal under the control of the control signal; and the high-resolution signal output unit is used to output the high-resolution signal to the corresponding one row of pixels.

Optionally, the high-resolution signal generation unit includes an eleventh switching transistor, a second capacitor and a twelfth switching transistor;

a control terminal of the eleventh switching transistor is connected to a first end of the second capacitor and the driving module, respectively, a first terminal of the eleventh switching transistor is connected to a second clock signal generation unit, and a second terminal of the eleventh switching transistor is connected to a second end of the second capacitor, a first terminal of the twelfth switching transistor and the high-resolution signal output unit, respectively; and a control terminal of the twelfth switching transistor is connected to the driving module, and a second terminal of the twelfth switching transistor is connected to the third power supply.

Optionally, the high-resolution signal output unit includes a thirteenth switching transistor;

a control terminal of the thirteenth switching transistor is connected to the sixth power supply, a first terminal of the thirteenth switching transistor is connected to the high-resolution signal generation unit, and a second terminal of the thirteenth switching transistor is connected to one row of pixels.

Optionally, the high-resolution signal output unit further includes a fourteenth switching transistor and a fifteenth switching transistor;

a control terminal of the fourteenth switching transistor is connected to the sixth power supply, a first terminal of the fourteenth switching transistor is connected to the high-resolution signal generation unit, and a second terminal of the fourteenth switching transistor is connected to a first terminal of the fifteenth switching transistor and the first terminal of the thirteenth switching transistor, respectively; and a control terminal of the fifteenth switching transistor is connected to the fifth power supply, and a second terminal of the fifteenth switching transistor is connected to the third power supply.

Optionally, the driving module includes a first switching transistor, a second switching transistor, a third switching transistor and a fourth switching transistor;

a control terminal of the first switching transistor is connected to a first power supply, a first terminal of the first switching transistor is connected to a second power supply, and a second terminal of the first switching transistor is connected to a first terminal of the third switching transistor, the low-resolution module and each of the high-resolution modules, respectively;

a control terminal of the second switching transistor is connected to a fourth power supply, a first terminal of the second switching transistor is connected to the second power supply, and a second terminal of the second switching transistor is connected to a control terminal of the third switching transistor, a first terminal of the fourth switching transistor, the low-resolution module and each of the high-resolution modules, respectively;

a second terminal of the third switching transistor is connected to the third power supply; and a control terminal of the fourth switching transistor is connected to the first power supply, and a second terminal of the fourth switching transistor is connected to the third power supply.

Optionally, the number of the high-resolution modules equals to the number of the rows of pixels to which the low-resolution module outputs the low-resolution signal.

To achieve the above object, the present invention also provides a display device, which includes the above-mentioned GOA circuit.

To achieve the above object, the present invention further provides a driving method of a GOA circuit, the GOA circuit including a driving module, a low-resolution module and at least two high-resolution modules; wherein the driving method comprises:

outputting, by the driving module, control signals to the low-resolution module and every high-resolution module, respectively;

during low-resolution display, outputting, by the low-resolution module, a low-resolution signal to at least two rows of pixels under the control of the control signal; and during high-resolution display, outputting, by each high-resolution module, a high-resolution signal, to corresponding one row of pixels under the control of the control signal.

Optionally, the low-resolution module includes a low-resolution signal generation unit and a low-resolution signal output unit, and each high-resolution module includes a high-resolution signal generation unit and a high-resolution signal output unit;

during the low-resolution display, working procedure of the GOA circuit comprises a charging stage, a signal generating stage and a reset stage; wherein, during the charging stage, the driving module drives the low-resolution signal generation unit in the low-resolution module and the high-resolution signal generation unit in the high-resolution module to charge;

during the signal generating stage, the low-resolution signal generation unit generates the low-resolution signal, and outputs the same to the at least two rows of pixels; and during the reset stage, the driving module drives the low-resolution signal generation unit in the low-resolution module and the high-resolution signal generation unit in the high-resolution module to discharge so as to be reset.

Optionally, during the signal generating stage of the low-resolution display, the low-resolution signal generation unit generates, driven by the driving module, the low-resolution signal according to a first clock signal.

Optionally, the driving module is connected to a first power supply, a second power supply, a third power supply and a fourth power supply, respectively; the low-resolution module is connected to a first clock signal generation unit, the third power supply, the fifth power supply and the sixth power supply, respectively; each of the high-resolution modules is connected to a clock signal generating unit different from the first clock signal generation unit, the third power supply, the fifth power supply and the sixth power supply; the second power supply outputs a high-level signal and the third power supply outputs a low-level signal; during the low-resolution display, the fifth power supply outputs a high-level signal, and the sixth power supply outputs a low-level signal;

during the charging stage of the low-resolution display, the first power supply outputs a high-level signal, and the control signal is a high-level signal;

during the signal generating stage of the low-resolution display, the first power supply outputs a low-level signal, the first clock signal generation unit outputs a high-level signal, and the low-resolution signal is a high-level signal; and during the reset stage of the low-resolution display, the first power supply outputs a low-level signal, and the fourth power supply outputs a high-level signal.

Optionally, the low-resolution module includes a low-resolution signal generation unit and a low-resolution signal output unit, and each of the high-resolution modules includes a high-resolution signal generation unit and a high-resolution signal output unit;

during the high-resolution display, working procedure of the GOA circuit comprises a charging stage, a signal generating stage and a reset stage; wherein, during the charging stage, the driving module drives the low-resolution signal generation unit in the low-resolution module and the high-resolution signal generation unit in the high-resolution module to charge;

during the signal generating stage, the high-resolution signal generation unit generates the high-resolution signal, and outputs the same to the corresponding one row of pixels; and during the reset stage, the driving module drives the low-resolution signal generation unit in the low-resolution module and the high-resolution signal generation unit in the high-resolution module are driven to discharge so as to be reset.

Optionally, the GOA circuit includes two high-resolution modules which are a first high-resolution module and a second high-resolution module, respectively; during the signal generating stage of the high-resolution display, the high-resolution signal generated by the high-resolution signal generation unit of the first high-resolution module is output to the first row of pixels through the high-resolution signal output unit of the first high-resolution module under the control of the second clock signal, and the high-resolution signal generated by the high-resolution signal generation unit of the second high-resolution module is output to the second row of pixels through the high-resolution signal output unit of the second high-resolution module under the control of the third clock signal.

Optionally, the driving module is connected to the first power supply, the second power supply, the third power supply and the fourth power supply, respectively; the low-resolution module is connected to the first clock signal generation unit, the third power supply, the fifth power supply and the sixth power supply, respectively; each of the high-resolution modules is connected to a clock signal generation unit different from the first clock signal generation unit, the third power supply, the fifth power supply and the sixth power supply; the second power supply outputs a high-level signal, the third power supply outputs a low-level signal; and during the high-resolution display, the fifth power supply outputs a low-level signal, and the sixth power supply outputs a high-level signal;

during the charging stage of the high-resolution display, the first power supply outputs a high-level signal, and the control signal is a high-level signal;

during the signal generating stage of the high-resolution display, the first power supply outputs a low-level signal, the clock signal generation units different from the first clock signal generation unit sequentially output high-level signals, and the high-resolution signal is a high-level signal; and during the reset stage of the high-resolution display, the first power supply outputs a low-level signal, and the fourth power supply outputs a high-level signal.

The present invention has the following advantageous effects:

in the technical solution of the GOA circuit, the driving method thereof and the display device provided by the present invention, since the low-resolution module can output the low-resolution signal to at least two rows of pixels respectively during the low-resolution display and each high-resolution module can output the high-resolution signal to one row of pixels during the high-resolution display, each GOA circuit can be used to drive multiple rows of pixels, so that the number of the GOA circuits in the display device is reduced; in addition, the GOA circuit provided by the present invention can also implement the switching between low resolution display and high resolution display, thereby lowering the power consumption and saving energy.

DETAILED DESCRIPTION OF THE EMBODIMENTS

To make those skilled in the art better understand the technical solutions of the present invention, embodiments provided by the present invention are described in detail below in conjunction with the accompanying drawings.

The present invention provides a GOA (Gate driver On Array) circuit which comprises a driving module, a low-resolution module and at least two high-resolution modules, the driving module being connected with the low-resolution module and the at least two high-resolution modules, respectively. The driving module is used to output a control signal to the low-resolution module and each of the high-resolution modules, respectively, the low-resolution module is used to output a low-resolution signal to at least two rows of pixels under the control of the control signal during low-resolution display, and each high-resolution module is used to output a high-resolution signal to one row of pixels under the control of the control signal during high-resolution display.

Preferably, the number of the high-resolution modules equals to the number of rows of pixels to which the low-resolution module outputs the low-resolution signal. In other words, if the low-resolution module outputs the low-resolution signal to N rows of pixels, respectively, the GOA circuit includes N high-resolution modules, where N is an integer equal to or larger than 2.

In the embodiments of the present invention, detailed description is given by taking a case where a GOA circuit includes one low-resolution module and two high-resolution modules as an example. The two high-resolution modules are a first high-resolution module and a second high-resolution module, respectively.

Figure 1:
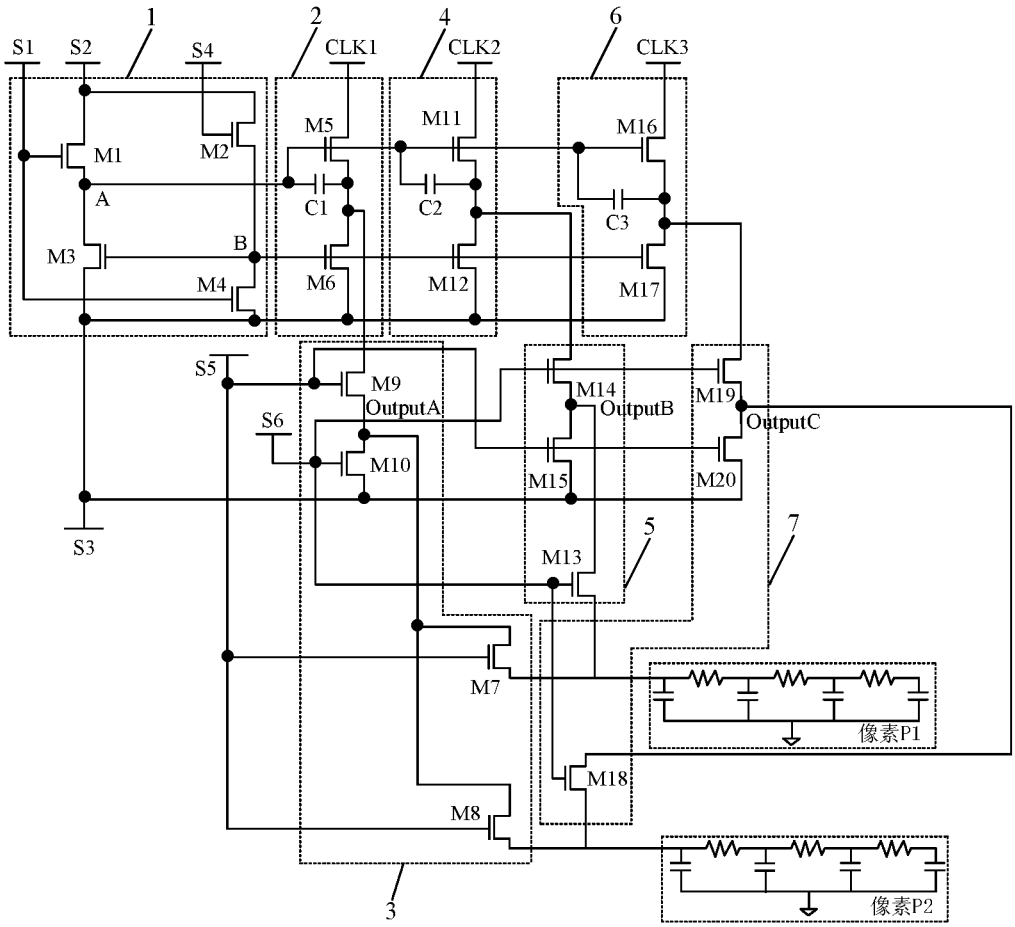
FIG. 1 is a structural schematic diagram of a GOA circuit provided by an embodiment of the present invention.

FIG. 1 is a structural schematic diagram of a GOA circuit provided by embodiments of the present invention. As illustrated in FIG. 1, the GOA circuit includes a driving module 1, a low-resolution module, a first high-resolution module and a second high-resolution module, the driving module 1 being connected to the low-resolution module, the first high-resolution module and the second high-resolution module, respectively. The driving module 1 is used to output a control signal to the low-resolution module, the first high-resolution module and the second high-resolution module, respectively; the low-resolution module is used to output the same low-resolution signal to at least two rows of pixels respectively under the control of the control signal during low-resolution display; the first high-resolution module is used to output a first high-resolution signal to a first row of pixels under the control of the control signal during high-resolution display, and the second high-resolution module is used to output a second high-resolution signal to a second row of pixels under the control of the control signal during the high-resolution display.

The low-resolution module of the GOA circuit according to the embodiments of the present invention includes a low-resolution signal generation unit 2 and a low-resolution signal output unit 3. The low-resolution signal generation unit 2 is used to generate the low-resolution signal according to the first clock signal under the control of the control signal, and the low-resolution signal output unit 3 is used to output the low-resolution signal to at least two rows of pixels.

Here, the low-resolution signal generation unit 2 includes the fifth switching transistor M5, the first capacitor C1 and the sixth switching transistor M6. The control terminal of the fifth switching transistor M5 is connected to the first end of the first capacitor C1 and the driving module 1, respectively, the first terminal of the fifth switching transistor M5 is connected to the first clock signal generation unit CLK1, and the second terminal of the fifth switching transistor M5 is connected to the second end of the first capacitor C1, the first terminal of the sixth switching transistor M6 and the low-resolution signal output unit 3, respectively; and the control terminal of the sixth switching transistor M6 is connected to the driving module 1 and the second terminal of the sixth switching transistor M6 is connected to the third power supply S3.

In the embodiments of the present invention, detailed description is given by taking, as an example, a case where the low-resolution signal output unit 3 outputs the low-resolution signal to the first row of pixels P1 and the second row of pixels P2, respectively. The low-resolution signal output unit 3 includes the seventh switching transistor M7 and the eighth switching transistor M8. The control terminal of the seventh switching transistor M7 is connected to the fifth power supply S5, the first terminal of the seventh switching transistor M7 is connected to the first terminal of the eighth switching transistor M8 and the low-resolution signal generation unit 2, respectively, and the second terminal of the seventh switching transistor M7 is connected to the first row of pixels P1; the control terminal of the eighth switching transistor M8 is connected to the fifth power supply S5, and the second terminal of the eighth switching transistor M8 is connected to the second row of pixels P2. Specifically, the first terminal of the seventh switching transistor M7 and the first terminal of the eighth switching transistor M8 may both be directly connected to the second terminal of the fifth switching transistor M5 to implement the respective connections of the first terminals of the seventh switching transistor M7 and the eighth switching transistor M8 with the low-resolution signal generation unit 2, and as an optional embodiment, such case is not shown in the figures.

Optionally, the low-resolution signal output unit 3 further includes the ninth switching transistor M9 and the tenth switching transistor M10. The control terminal of the ninth switching transistor M9 is connected to the fifth power supply S5, the first terminal of the ninth switching transistor M9 is connected to the low-resolution signal generation unit 2, and the second terminal of the ninth switching transistor M9 is connected to the first terminal of the tenth switching transistor M10, the first terminal of the seventh switching transistor M7 and the first terminal of the eighth switching transistor M8, respectively; and the control terminal of the tenth switching transistor M10 is connected to the sixth power supply S6 and the second terminal of the tenth switching transistor M10 is connected to the third power supply S3. The first terminal of the ninth switching transistor M9 is connected to the second terminal of the fifth switching transistor M5 to implement the connection of the first terminal of the ninth switching transistor M9 with the low-resolution signal generation unit 2.

In the embodiments of the present invention, the first high-resolution module includes the first high-resolution signal generation unit 4 and the first high-resolution signal output unit 5, and the second high-resolution module includes the second high-resolution signal generation unit 6 and the second high-resolution signal output unit 7. The first high-resolution signal generation unit 4 is used to generate the first high-resolution signal according to the second clock signal under the control of the control signal, and the first high-resolution signal output unit 5 is used to output the first high-resolution signal to the first row of pixels P1; the second high-resolution signal generation unit 6 is used to generate the second high-resolution signal according to the third clock signal under the control of the control signal, and the second high-resolution signal output unit 7 is used to output the second high-resolution signal to the second row of pixels P2.

The first high-resolution signal generation unit 4 includes the eleventh switching transistor M11, the second capacitor C2 and the twelfth switching transistor M12. The control terminal of the eleventh switching transistor M11 is connected to the first end of the second capacitor C2 and the driving module 1, respectively, the first terminal of the eleventh switching transistor M11 is connected to the second clock signal generation unit CLK2, and the second terminal of the eleventh switching transistor M11 is connected to the second end of the second capacitor C2, the first terminal of the twelfth switching transistor M12 and the first high-resolution signal output unit 5, respectively; the control terminal of the twelfth switching transistor M12 is connected to the driving module 1, and the second terminal of the twelfth switching transistor M12 is connected to the third power supply S3.

The first high-resolution signal output unit 5 includes the thirteenth switching transistor M13. The control terminal of the thirteenth switching transistor M13 is connected to the sixth power supply S6, the first terminal of the thirteenth switching transistor M13 is connected to the first high-resolution signal generation unit 4, and the second terminal of the thirteenth switching transistor M13 is connected to the first row of pixels P1. Specifically, the first terminal of the thirteenth switching transistor M13 may be directly connected to the second terminal of the eleventh switching transistor M11 to implement the connection of the first terminal of the thirteenth switching transistor M13 with the first high-resolution signal generation unit 4, and as an optional embodiment, such case is not shown in the figures.

Optionally, the first high-resolution signal output unit 5 further includes the fourteenth switching transistor M14 and the fifteenth switching transistor M15. The control terminal of the fourteenth switching transistor M14 is connected to the sixth power supply S6, the first terminal of the fourteenth switching transistor M14 is connected to the first high-resolution signal generation unit 4, and the second terminal of the fourteenth switching transistor M14 is connected to the first terminal of the fifteenth switching transistor M15 and the first terminal of the thirteenth switching transistor M13, respectively; and the control terminal of the fifteenth switching transistor M15 is connected to the fifth power supply S5, and the second terminal of the fifteenth switching transistor M15 is connected to the third power supply S3.

The second high-resolution signal generation unit 6 includes the sixteenth switching transistor M16, the third capacitor C3 and the seventeenth switching transistor M17. The control terminal of the sixteenth switching transistor M16 is connected to the first end of the third capacitor C3 and the driving module 1, respectively, the first terminal of the sixteenth switching transistor M16 is connected to the third clock signal generation unit CLK3, and the second terminal of the sixteenth switching transistor M16 is connected to the second end of the third capacitor C3, the first terminal of the seventeenth switching transistor M17 and the second high-resolution signal output unit 7, respectively; the control terminal of the seventeenth switching transistor M17 is connected to the driving module 1, and the second terminal of the seventeenth switching transistor M17 is connected to the third power supply S3.

The second high-resolution signal output unit 7 includes the eighteenth switching transistor M18. The control terminal of the eighteenth switching transistor M18 is connected to the sixth power supply S6, the first terminal of the eighteenth switching transistor M18 is connected to the second high-resolution signal generation unit 6, and the second terminal of the eighteenth switching transistor M18 is connected to the second row of pixels P2. Specifically, the first terminal of the eighteenth switching transistor M18 may be directly connected to the second terminal of the sixteenth switching transistor M16 to implement the connection of the first terminal of the eighteenth switching transistor M18 with the second high-resolution signal generation unit 6, and as an optional embodiment, such case is not shown in the figures.

Optionally, the second high-resolution signal output unit 7 further includes the nineteenth switching transistor M19 and the twentieth switching transistor M20. The control terminal of the nineteenth switching transistor M19 is connected to the sixth power supply S6, the first terminal of the nineteenth switching transistor M19 is connected to the second high-resolution signal generation unit 6, and the second terminal of the nineteenth switching transistor M19 is connected to the first terminal of the twentieth switching transistor M20 and the first terminal of the eighteenth switching transistor M18, respectively; and the control terminal of the twentieth switching transistor M20 is connected to the fifth power supply S5, and the second terminal of the twentieth switching transistor M20 is connected to the third power supply S3.

In the embodiments of the present invention, the driving module 1 includes the first switching transistor M1, the second switching transistor M2, the third switching transistor M3 and the fourth switching transistor M4. The control terminal of the first switching transistor M1 is connected to the first power supply Si, the first terminal of the first switching transistor M1 is connected to the second power supply S2, and the second terminal of the first switching transistor M1 is connected to the first terminal of the third switching transistor M3, the low-resolution module, the first high-resolution module and the second high-resolution module, respectively; the control terminal of the second switching transistor M2 is connected to the fourth power supply S4, the first terminal of the second switching transistor M2 is connected to the second power supply S2, and the second terminal of the second switching transistor M2 is connected to the control terminal of the third switching transistor M3, the first terminal of the fourth switching transistor M4, the low-resolution module, the first high-resolution module and the second high-resolution module, respectively; the second terminal of the third switching transistor M3 is connected to the third power supply S3; and the control terminal of the fourth switching transistor M4 is connected to the first power supply Si, and the second terminal of the fourth switching transistor M4 is connected to the third power supply S3. Specifically, the second terminal of the first switching transistor M1 is connected to the control terminal of the fifth switching transistor M5 and the first end of the first capacitor C1, respectively, to implement the connection of the second terminal of the first switching transistor M1 with the low-resolution signal generation unit 2 of the low-resolution module; the second terminal of the first switching transistor M1 is connected to the control terminal of the eleventh switching transistor M11 and the first end of the second capacitor C2, respectively, to implement the connection of the second terminal of the first switching transistor M1 with the first high-resolution signal generation unit 4 of the first high-resolution module; the second terminal of the first switching transistor M1 is connected to the control terminal of the sixteenth switching transistor M16 and the first end of the third capacitor C3, to implement the connection of the second terminal of the first switching transistor M1 with the second high-resolution signal generation unit 6 of the second high-resolution module. Specifically, the second terminal of the second switching transistor M2 is connected to the control terminal of the sixth switching transistor M6, to implement the connection of the second terminal of the second switching transistor M2 with the low-resolution signal generation unit 2 of the low-resolution module; the second terminal of the second switching transistor M2 is connected to the control terminal of the twelfth switching transistor M12, to implement the connection of the second terminal of the second switching transistor M2 with the first high-resolution signal generation unit 4 of the first high-resolution module; and the second terminal of the second switching transistor M2 is connected to the control terminal of the seventeenth switching transistor M17, to implement the connection of the second terminal of the second switching transistor M2 with the second high-resolution signal generation unit 6 of the second high-resolution module.

The working procedure of the GOA circuit shown in FIG. 1 is described in detail below with reference to FIGS. 2 and 3.

Figure 2:
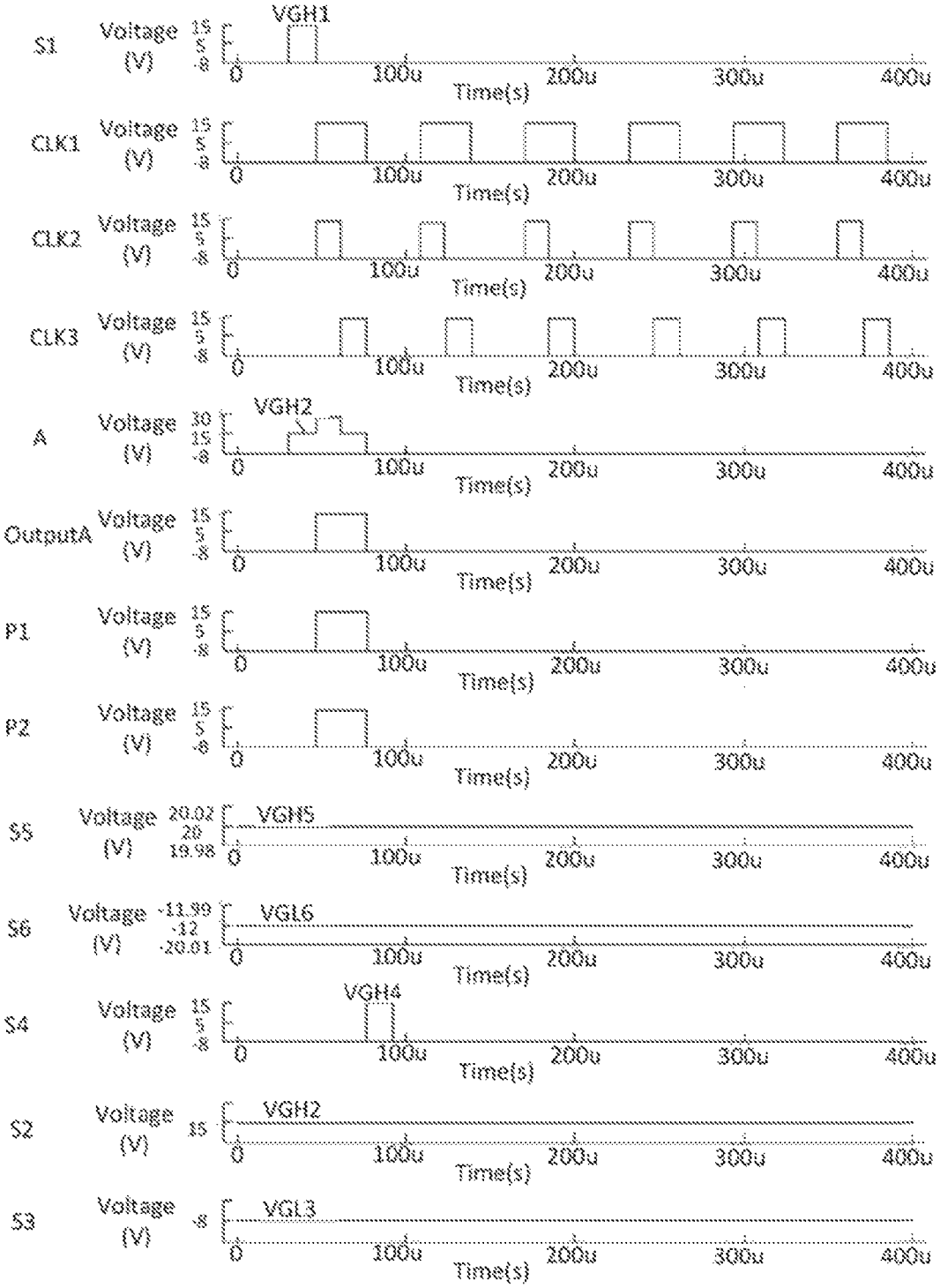
FIG. 2 is a signal timing diagram of the GOA circuit illustrated in FIG. 1 during low-resolution display.

FIG. 2 is a signal timing diagram of the GOA circuit illustrated in FIG. 1 during the low-resolution display. As shown in FIGS. 1 and 2, the working procedure of the GOA circuit during the low-resolution display may be divided into the following three stages:

Charging Stage:

The first power supply 51 outputs the high-level signal VGH1, so the first switching transistor M1 and the fourth switching transistor M4 are turned on, and the second power supply S2 outputs the high-level signal VGH2, so the control signal output from the second terminal of the first switching transistor M1 (i.e., the node A) is VGH2; at this time, the voltage at the control terminal of the fifth switching transistor M5 and the first end of the first capacitor C1 is VGH2, so the fifth switching transistor M5 is turned on and the second power supply S2 starts to charge the first capacitor C1 through the control signal VGH2; meanwhile, the voltage at the control terminal of the eleventh switching transistor M11 and the first end of the second capacitor C2 is VGH2, so the eleventh switching transistor M11 is turned on and the second power supply S2 starts to charge the second capacitor C2 through the control signal VGH2; at the same time, the voltage at the control terminal of the sixteenth switching transistor M16 and the first end of the third capacitor C3 is VGH2, so the sixteenth switching transistor M16 is turned on and the second power supply S2 starts to charge the third capacitor C3 through the control signal VGH2. After the fourth switching transistor M4 is turned on, the voltage at the first terminal of the fourth switching transistor M4 (i.e., the node B) is a low-level signal VGL3 output from the third power supply S3, and because the control terminal of the third switching transistor M3, the control terminal of the sixth switching transistor M6, the control terminal of the twelfth switching transistor M12 and the control terminal of the seventeenth switching transistor M17 are all connected to the node B and the voltage at the node B is the low-level signal VGL3, it can be effectively ensured that the third switching transistor M3, the sixth switching transistor M6, the twelfth switching transistor M12 and the seventeenth switching transistor M17 are off.

Signal Generation Stage:

The first power supply 51 outputs the low-level signal VGL1, so the first switching transistor M1 and the fourth switching transistor M4 are turned off. During this stage, the voltage at the node A is further increased due to capacitance coupling effect, so that the fifth switching transistor M5, the eleventh switching transistor M11 and the sixteenth switching transistor M16 may continue to be on. At this time, the first clock signal generation unit CLK1 outputs a first clock signal VCLK1 which is sent to the second terminal of the fifth switching transistor M5 to be selected as the output. The low-resolution signal output from the second terminal of the fifth switching transistor M5 to the first terminal of the ninth switching transistor M9 is VCLK1. Since the fifth power supply S5 continuously outputs the high-level signal VGH5, the ninth switching transistor M9, the fifteenth switching transistor M15, the twentieth switching transistor M20, the seventh switching transistor M7 and the eighth switching transistor M8 are on; since the sixth power supply S6 continuously outputs the low-level signal VGL6, the tenth switching transistor M10, the fourteenth switching transistor M14, the nineteenth switching transistor M19, the thirteenth switching transistor M13 and the eighteenth switching transistor M18 are off. Since the ninth switching transistor M9, the seventh switching transistor M7 and the eighth switching transistor M8 are on, the low-resolution signal VCLK1 output from the second terminal of the fifth switching transistor M5 is output to the second terminal of the ninth switching transistor M9 (the node OutputA) via the first terminal of the ninth switching transistor M9, and is output to the first row of pixels P1 via the seventh switching transistor M7 and the second row of pixels P2 via the eighth switching transistor M8 at the same time. During the process of the first clock signal generation unit CLK1 outputting the first clock signal VCLK1, the second clock signal generation unit CLK2 and the third clock signal generation unit CLK3 sequentially output the second clock signal VCLK2 and the third clock signal VCLK3, wherein the second clock signal VCLK2 does not overlap with the third clock signal VCLK3, and the second clock signal VCLK2 is sent to the second terminal of the eleventh switching transistor M11 to be selected as the output because the eleventh switching transistor M11 and the sixteenth switching transistor M16 are both on, so that the voltage at the second end of the second capacitor C2 and the second terminal of the eleventh switching transistor M11 is VCLK2; and, the third clock signal VCLK3 is sent to the second terminal of the sixteenth switching transistor M16 to be selected as the output, so that the voltage at the second end of the third capacitor C3 and the second terminal of the sixteenth switching transistor M16 is VCLK3. It should be noted that the voltage output from the node A in FIG. 2 is stepped downward, that is, is downwardly stepwise, under the influence of the coupling effect of the capacitors C1, C2 and C3.

Reset Stage:

The fourth power supply outputs the high-level signal VGH4, so the second switching transistor M2 is turned on, and the high-level signal VGH2 is output from the second power supply S2 to the node B through the on-state second switching transistor M2 and thus causes the third switching transistor M3, the sixth switching transistor M6, the twelfth switching transistor M12 and the seventeenth switching transistor M17 to be turned on, such that the first and second ends of the first capacitor C1, the first and second ends of the second capacitor C2 and the first and second ends of the third capacitor C3 are all connected to the third power supply S3. The first capacitor C1, the second capacitor C2 and the third capacitor C3 discharge until voltages at both ends of each of the first capacitor C1, the second capacitor C2 and the third capacitor C3 drop to a low level. Subsequently, the working process of the charging stage may be performed to output the low-resolution signal to other pixels.

It should be noted that the voltage values of VGH1, VGH2, VGL3, VGH4, VGH5 and VGL6 in FIG. 2 should satisfy the following condition:

$$VGH5>VGH1=VGH2=VGH4>VGL3>VGL6.$$

Figure 3:
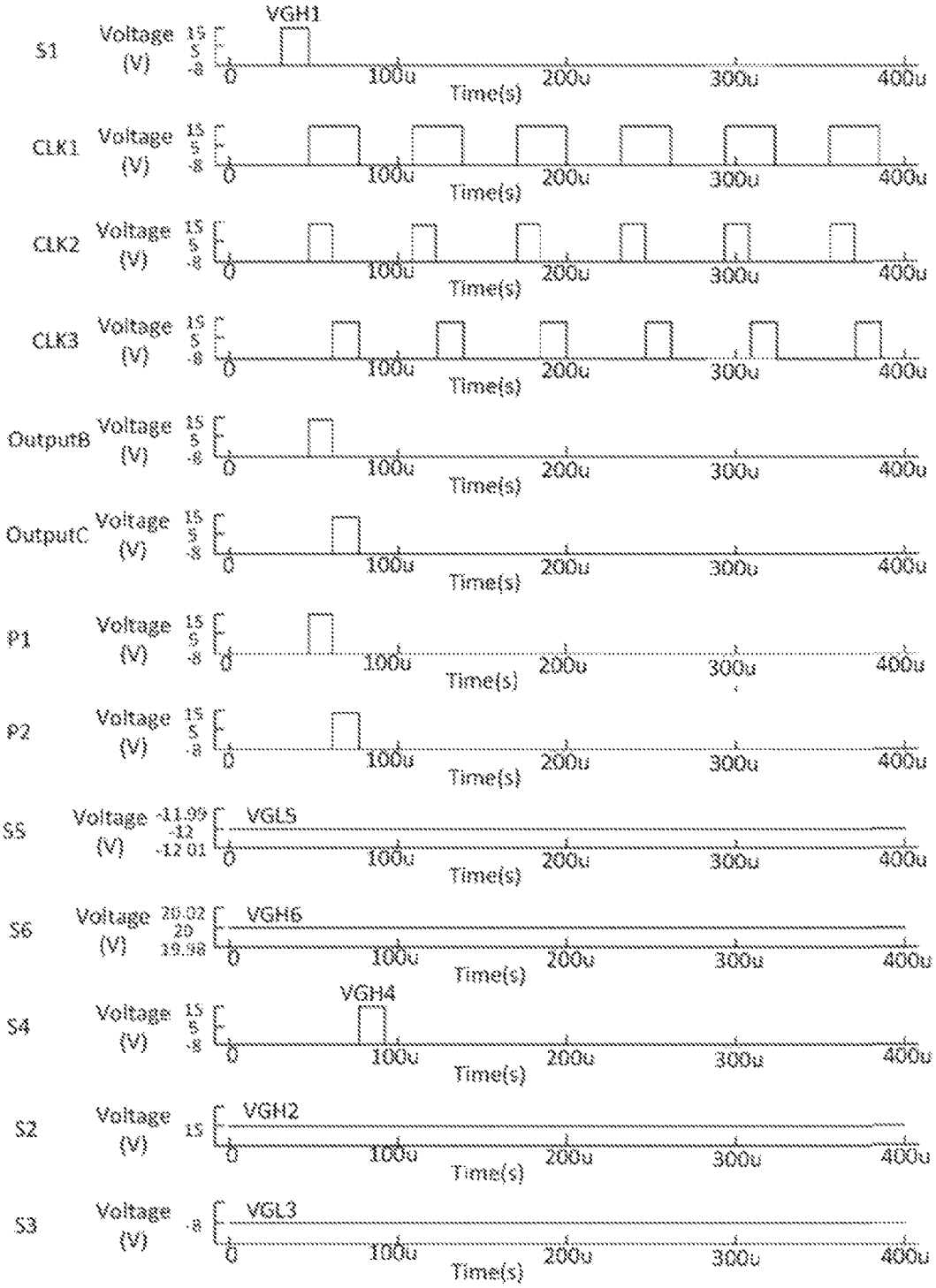
FIG. 3 is a signal timing diagram of the GOA circuit illustrated in FIG. 1 during high-resolution display.

FIG. 3 is a signal timing diagram of the GOA circuit illustrated in FIG. 1 during the high-resolution display. As shown in FIGS. 1 and 3, the working procedure of the GOA circuit during the high-resolution display may be divided into the following three stages:

Charging Stage:

The first power supply 51 outputs the high-level signal VGH1, so the first switching transistor M1 and the fourth switching transistor M4 are turned on, and the second power supply S2 outputs the high-level signal VGH2, so the control signal output from the second terminal of the first switching transistor M1 (i.e., the node A) is VGH2; at this time, the voltage at the control terminal of the fifth switching transistor M5 and the first end of the first capacitor C1 is VGH2, so the fifth switching transistor M5 is turned on and the second power supply S2 starts to charge the first capacitor C1 through the control signal VGH2; at the same time, the voltage at the control terminal of the eleventh switching transistor M11 and the first end of the second capacitor C2 is VGH2, so the eleventh switching transistor M11 is turned on and the second power supply S2 starts to charge the second capacitor C2 through the control signal VGH2; at the same time, the voltage at the control terminal of the sixteenth switching transistor M16 and the first end of the third capacitor C3 is VGH2, so the sixteenth switching transistor M16 is turned on and the second power supply S2 starts to charge the third capacitor C3 through the control signal VGH2. Here, after the fourth switching transistor M4 is turned on, the voltage at the first terminal of the fourth switching transistor M4 (i.e., the node B) is the low-level signal VGL3 output from the third power supply S3, and for the reason that the control terminal of the third switching transistor M3, the control terminal of the sixth switching transistor M6, the control terminal of the twelfth switching transistor M12 and the control terminal of the seventeenth switching transistor M17 are all connected to the node B and the voltage at the node B is the low-level signal VGL3, it can be effectively ensured that the third switching transistor M3, the sixth switching transistor M6, the twelfth switching transistor M12 and the seventeenth switching transistor M17 are off. The voltage output from the node A may refer to FIG. 2, and is not specifically shown in FIG. 3.

Signal Generation Stage:

The first power supply S1 outputs the low-level signal VGL1, so the first switching transistor M1 and the fourth switching transistor M4 are turned off. During this stage, the voltage at the node A is further increased due to the capacitance coupling effect so that the fifth switching transistor M5, the eleventh switching transistor M11 and the sixteenth switching transistor M16 may continue to be on. At this time, the second clock signal generation unit CLK2 outputs a second clock signal VCLK2 which is sent to the second terminal of the eleventh switching transistor M11 to be selected as the output. The high-resolution signal output from the second terminal of the eleventh switching transistor M11 to the first terminal of the twelfth switching transistor M12 is VCLK2. Since the fifth power supply S5 continuously outputs the low-level signal VGL5, the ninth switching transistor M9, the fifteenth switching transistor M15, the twentieth switching transistor M20, the seventh switching transistor M7 and the eighth switching transistor M8 are off; since the sixth power supply S6 continuously outputs the high-level signal VGH6, the tenth switching transistor M10, the fourteenth switching transistor M14, the nineteenth switching transistor M19, the thirteenth switching transistor M13 and the eighteenth switching transistor M18 are on. Since the fourteenth switching transistor M14 and the thirteenth switching transistor M13 are on, the high-resolution signal VCLK2 output from the second terminal of the eleventh switching transistor M11 is output to the second terminal of the fourteenth switching transistor M14 (the node OutputB) through the first terminal of the fourteenth switching transistor M14, and is output to the first row of pixels P1 via the thirteenth switching transistor M13. Subsequently, the third clock signal generation unit CLK3 outputs the third clock signal VCLK3, which is sent to the second terminal of the sixteenth switching transistor M16 to be selected as the output. The high-resolution signal VCLK3 output from the second terminal of the sixteenth switching transistor M16 is output to the second terminal of the nineteenth switching transistor M19 (the node OutputC) through the first terminal of the nineteenth switching transistor M19, and is output to the second row of pixels P2 through the eighteenth switching transistor M18.

Reset Stage:

The fourth power supply S4 outputs the high-level signal VGH4, so the second M2 is turned on, and the high-level signal VGH2 is output from the second power supply S2 to the node B via the on-state second switching transistor M2 and thus causes the third switching transistor M3, the sixth switching transistor M6, the twelfth switching transistor M12 and the seventeenth switching transistor M17 to be turned on, such that the first and second ends of the first capacitor C1, the first and second ends of the second capacitor C2 and the first and second ends of the third capacitor C3 are all connected to the third power supply S3. The first capacitor C1, the second capacitor C2 and the third capacitor C3 discharge, so that both ends of each of the first capacitor C1, the second capacitor C2 and the third capacitor C3 drop to a low level. Subsequently, the working process of the charging stage may be performed to output the high-resolution signal to other pixels.

It should be noted that the voltage values of respective signals shown in FIGS. 2 and 3 are only illustrative, they are intended to indicate high or low levels of the respective signals and are not intended to limit the present invention.

In the GOA circuit provided by the embodiments of the present invention, since the low-resolution module can output the low-resolution signal to at least two rows of pixels respectively during the low-resolution display and each high-resolution module can output the high-resolution signal to the corresponding one row of pixels during the high-resolution display, each GOA circuit can be used to drive multiple rows of pixels, so that the number of the GOA circuits in the display device is reduced; in addition, the GOA circuit provided by the present invention can also implement the switching between low resolution display and high resolution display, so that the resolution of an array substrate can be set flexibly, the power consumption is lowered and energy is saved.

The present invention also provides a display device including a GOA circuit, which may be the above-provided GOA circuit and is not described repetitively.

In the display device provided by the present invention, the number of GOA circuits is reduced due to the above-mentioned GOA circuit included therein which can be used to drive multiple rows of pixels; the GOA circuit can also implement the switching between low resolution display and high resolution display, so that the resolution of an array substrate can be set flexibly, the power consumption is lowered and energy is saved.

The present invention also provides a driving method of a GOA circuit, the driving method is used for driving the GOA circuit, the GOA circuit includes a driving module, a low-resolution module and at least two high-resolution modules, and the driving module is connected to the low-resolution module and each of the high-resolution modules, respectively.

In the embodiment, the driving method comprises:

outputting, by the driving module, a control signal to the low-resolution module and each of the high-resolution modules, respectively;

during low-resolution display, outputting, by the low-resolution module, a low-resolution signal to at least two rows of pixels under the control of the control signal; and during high-resolution display, outputting, by each of the at least two high-resolution modules, a high-resolution signal to corresponding one row of pixels under the control of the control signal.

Optionally, the driving module is connected to the first power supply, the second power supply, the third power supply and the fourth power supply, respectively; the low-resolution module is connected to the first clock signal generation unit, the third power supply, the fifth power supply and the sixth power supply, respectively; each of the at least two high-resolution modules is connected to a clock signal generating unit different from the first clock signal generation unit, the third power supply, the fifth power supply and the sixth power supply, and for example, if the GOA circuit includes two high-resolution modules, one high-resolution module is connected to the second clock signal generation unit, the third power supply, the fifth power supply and the sixth power supply, respectively, and the other high-resolution module is connected to the third clock signal generation unit, the third power supply, the fifth power supply and the sixth power supply; the second power supply outputs a high-level signal and the third power supply outputs a low-level signal, and during the low-resolution display, the fifth power supply outputs a high-level signal, and the sixth power supply outputs a low-level signal;

during the charging stage of the low-resolution display, the first power supply outputs a high-level signal, and the control signal is a high-level signal;

during the signal generating stage of the low-resolution display, the first power supply outputs a low-level signal, the first clock signal generation unit outputs a high-level signal, and the low-resolution signal is a high-level signal; and during the reset stage of the low-resolution display, the first power supply outputs a low-level signal, and the fourth power supply outputs a high-level signal.

Optionally, the driving module is connected to the first power supply, the second power supply, the third power supply and the fourth power supply, respectively; the low-resolution module is connected to the first clock signal generation unit, the third power supply, the fifth power supply and the sixth power supply, respectively; each of the at least two high-resolution modules is connected to a clock signal generating unit different from the first clock signal generation unit, the third power supply, the fifth power supply and the sixth power supply, respectively; the second power supply outputs a high-level signal and the third power supply outputs a low-level signal, and during the high-resolution display, the fifth power supply outputs a low-level signal, and the sixth power supply outputs a high-level signal;

during the charging stage of the high-resolution display, the first power supply outputs a high-level signal, and the control signal is a high-level signal;

during the signal generating stage of the high-resolution display, the first power supply outputs a low-level signal, the second clock signal generation unit outputs a high-level signal, and the high-resolution signal is a high-level signal; and during the reset stage of the high-resolution display, the first power supply outputs a low-level signal, and the fourth power supply outputs a high-level signal.

The driving method of a GOA circuit provided by the present invention is used to drive the above-mentioned GOA circuit, the detailed description of which can refer to the above embodiments.

The driving method of a GOA circuit provided by present invention can be used for driving the GOA circuit which can be used to drive multiple rows of pixels, so that the number of GOA circuits in a display device is reduced. In addition, the GOA circuit can also implement the switching between low resolution display and high resolution display, thereby lowering the power consumption and saving energy.

It can be understood that the foregoing implementations are merely exemplary implementations used for describing the principle of the present invention, but the present invention is not limited thereto. The terms such as "first", "eleventh" and the like used in the specification do not necessarily mean there are such number of components, but to distinguish the same type of components only. Those of ordinary skill in the art may make various variations and improvements without departing from the spirit and essence of the present invention, and these variations and improvements shall fall into the protection scope of the present invention.

The invention claimed is:

1. A Gate driver On Array (GOA) circuit, comprising:

a driving module, a low-resolution module and at least two high-resolution modules, the driving module being connected with the low-resolution module and the at least two high-resolution modules, respectively; wherein, the driving module is used to output a control signal to the low-resolution module and each of the high-resolution modules;

the low-resolution module is used to output a low-resolution signal to at least two rows of pixels under control of the control signal during low-resolution display; and each of the at least two high-resolution modules is used to output a high-resolution signal to corresponding one row of pixels under control of the control signal during high-resolution display, wherein the driving module includes a first switching transistor, a second switching transistor, a third switching transistor and a fourth switching transistor; and a control terminal of the first switching transistor is connected to a first power supply, a first terminal of the first switching transistor is connected to a second power supply, and a second terminal of the first switching transistor is connected to a first terminal of the third switching transistor, the low-resolution module and the high-resolution modules, respectively;

a control terminal of the second switching transistor is connected to a fourth power supply, a first terminal of the second switching transistor is connected to the second power supply, and a second terminal of the second switching transistor is connected to a control terminal of the third switching transistor, a first terminal of the fourth switching transistor, the low-resolution module and the at least two high-resolution modules, respectively;

a second terminal of the third switching transistor is connected to a third power supply; and a control terminal of the fourth switching transistor is connected to the first power supply, and a second terminal of the fourth switching transistor is connected to the third power supply.

2. The GOA circuit according to claim 1, wherein the low-resolution module includes:

a low-resolution signal generation unit which is used to generate the low-resolution signal according to a first clock signal under the control of the control signal; and a low-resolution signal output unit which is used to output the low-resolution signal to the at least two rows of pixels.

3. The GOA circuit according to claim 2, wherein the low-resolution signal generation unit includes a fifth switching transistor, a first capacitor and a sixth switching transistor; and a control terminal of the fifth switching transistor is connected to a first end of the first capacitor and the driving module, respectively, a first terminal of the fifth switching transistor is connected to a first clock signal generation unit, and a second terminal of the fifth switching transistor is connected to a second end of the first capacitor, a first terminal of the sixth switching transistor and the low-resolution signal output unit, respectively; and a control terminal of the sixth switching transistor is connected to the driving module, and a second terminal of the sixth switching transistor is connected to a third power supply.

4. The GOA circuit according to claim 2, wherein the low-resolution signal output unit includes a seventh switching transistor and an eighth switching transistor; wherein, a control terminal of the seventh switching transistor is connected to a fifth power supply, a first terminal of the seventh switching transistor is connected to a first terminal of the eighth switching transistor and the low-resolution signal generation unit, respectively, and a second terminal of the seventh switching transistor is connected to the first row of pixels; and a control terminal of the eighth switching transistor is connected to the fifth power supply, and a second terminal of the eighth switching transistor is connected to the second row of pixels.

5. The GOA circuit according to claim 4, wherein the low-resolution signal output unit further includes a ninth switching transistor and a tenth switching transistor; and a control terminal of the ninth switching transistor is connected to the fifth power supply, a first terminal of the ninth switching transistor is connected to the low-resolution signal generation unit, and a second terminal of the ninth switching transistor is connected to a first terminal of the tenth switching transistor, the first terminal of the seventh switching transistor and the first terminal of the eighth switching transistor, respectively; and a control terminal of the tenth switching transistor is connected to a sixth power supply, and a second terminal of the tenth switching transistor is connected to the third power supply.

6. The GOA circuit according to claim 1, wherein each of the at least two high-resolution modules includes:

a high-resolution signal generation unit which is used to generate the high-resolution signal according to a clock signal different from the first clock signal under the control of the control signal; and a high-resolution signal output unit which is used to output the high-resolution signal to the corresponding one row of pixels.

7. The GOA circuit according to claim 6, wherein the high-resolution signal generation unit includes an eleventh switching transistor, a second capacitor and a twelfth switching transistor; and a control terminal of the eleventh switching transistor is connected to a first end of the second capacitor and the driving module, respectively, a first terminal of the eleventh switching transistor is connected to a second clock signal generation unit, and a second terminal of the eleventh switching transistor is connected to a second end of the second capacitor, a first terminal of the twelfth switching transistor and the high-resolution signal output unit, respectively; and a control terminal of the twelfth switching transistor is connected to the driving module, and a second terminal of the twelfth switching transistor is connected to the third power supply.

8. The GOA circuit according to claim 6, wherein the high-resolution signal output unit includes a thirteenth switching transistor; and a control terminal of the thirteenth switching transistor is connected to a sixth power supply, a first terminal of the thirteenth switching transistor is connected to the high-resolution signal generation unit, and a second terminal of the thirteenth switching transistor is connected to one row of pixels.

9. The GOA circuit according to claim 8, wherein the high-resolution signal output unit further includes a fourteenth switching transistor and a fifteenth switching transistor; and a control terminal of the fourteenth switching transistor is connected to the sixth power supply, a first terminal of the fourteenth switching transistor is connected to the high-resolution signal generation unit, and a second terminal of the fourteenth switching transistor is connected to a first terminal of the fifteenth switching transistor and the first terminal of the thirteenth switching transistor, respectively; and a control terminal of the fifteenth switching transistor is connected to the fifth power supply, and a second terminal of the fifteenth switching transistor is connected to the third power supply.

10. The GOA circuit according to claim 1, wherein the number of the high-resolution modules equals to the number of the rows of pixels to which the low-resolution module outputs the low-resolution signal.

11. A display device, including the GOA circuit according to claim 1.

12. A driving method of a GOA circuit, wherein the GOA circuit includes a driving module, a low-resolution module and at least two high-resolution modules; and the driving method comprises:

outputting, by the driving module, a control signal to the low-resolution module and the at least two high-resolution modules, respectively;

during low-resolution display, outputting, by the low-resolution module, a low-resolution signal to at least two rows of pixels under control of the control signal; and during high-resolution display, outputting, by each of the at least two high-resolution modules, a high-resolution signal to corresponding one row of pixels under control of the control signal, wherein the low-resolution module includes a low-resolution signal generation unit and a low-resolution signal output unit, and each high-resolution module includes a high-resolution signal generation unit and a high-resolution signal output unit; and during the low-resolution display, working procedure of the GOA circuit omprises a charging stage, a signal generating stage and a reset stage; wherein, during the charging stage, the driving module drives the low-resolution signal generation unit in the low-resolution module and the high-resolution signal generation unit in the high-resolution module to charge;

during the signal generating stage, the low-resolution signal generation unit generates the low-resolution signal, and outputs the same to the at least two rows of pixels; and during the reset stage, the driving module drives the low-resolution signal generation unit in the low-resolution module and the high-resolution signal generation unit in the high-resolution module to discharge so as to be reset;

and wherein the driving module is connected to a first power supply, a second power supply, a third power supply and a fourth power supply, respectively; the low-resolution module is connected to a first clock signal generation unit, the third power supply, a fifth power supply and a sixth power supply, respectively; each of the at least two high-resolution modules is connected to a clock signal generating unit different from the first clock signal generation unit, the third power supply, the fifth power supply and the sixth power supply, respectively; the second power supply outputs a high-level signal and the third power supply outputs a low-level signal; and during the low-resolution display, the fifth power supply outputs a high-level signal and the sixth power supply outputs a low-level signal;

during the charging stage of the low-resolution display, the first power supply outputs a high-level signal, and the control signal is a high-level signal;

during the signal generating stage of the low-resolution display, the first power supply outputs a low-level signal, the first clock signal generation unit outputs a high-level signal, and the low-resolution signal is a high-level signal; and during the reset stage of the low-resolution display, the first power supply outputs a low-level signal, and the fourth power supply outputs a high-level signal.

13. The driving method of a GOA circuit according to claim 12, wherein in the signal generating stage of the low-resolution display, the low-resolution signal generation unit which is driven by the driving module generates the low-resolution signal according to a first clock signal.

14. The driving method of a GOA circuit according to claim 12, wherein the low-resolution module includes a low-resolution signal generation unit and a low-resolution signal output unit, and each of the at least two high-resolution modules includes a high-resolution signal generation unit and a high-resolution signal output unit; and during the high-resolution display, working procedure of the GOA circuit comprises a charging stage, a signal generating stage and a reset stage; wherein, during the charging stage, the driving module drives the low-resolution signal generation unit in the low-resolution module and the high-resolution signal generation unit in the high-resolution module to charge;

during the signal generating stage, each of the at least two high-resolution signal generation unit generates a high-resolution signal, and outputs the same to corresponding one row of pixels; and during the reset stage, the driving module drives the low-resolution signal generation unit in the low-resolution module and the high-resolution signal generation unit in the high-resolution module to discharge so as to be reset.

15. The driving method of a GOA circuit according to claim 14, wherein the GOA circuit includes two high-resolution modules, which are a first high-resolution module and a second high-resolution module, respectively; and during the signal generating stage of the high-resolution display, a first high-resolution signal generated by a first high-resolution signal generation unit of the first high-resolution module is output to a first row of pixels through a first high-resolution signal output unit of the first high-resolution module under the control of a second clock signal, and a second high-resolution signal generated by a second high-resolution signal generation unit of the second high-resolution module is output to a second row of pixels through a second high-resolution signal output unit of the second high-resolution module under the control of a third clock signal; and the second clock signal and the third clock signal are generated sequentially and do not overlap with each other.

* * * * *